US011536485B2

(12) United States Patent
Jang et al.

(10) Patent No.: US 11,536,485 B2
(45) Date of Patent: Dec. 27, 2022

(54) AIR CONDITIONER

(71) Applicant: SAMSUNG ELECTRONICS CO., LTD., Suwon-si (KR)

(72) Inventors: Eomji Jang, Suwon-si (KR); Sehoon Shin, Suwon-si (KR); Joonho Yoon, Suwon-si (KR); Kwonjin Kim, Suwon-si (KR); Yeonseob Yun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 308 days.

(21) Appl. No.: 16/769,322

(22) PCT Filed: Dec. 7, 2018

(86) PCT No.: PCT/KR2018/015487
§ 371 (c)(1),
(2) Date: Jun. 3, 2020

(87) PCT Pub. No.: WO2019/117544
PCT Pub. Date: Jun. 20, 2019

(65) Prior Publication Data

US 2020/0292204 A1 Sep. 17, 2020

(30) Foreign Application Priority Data

Dec. 14, 2017 (KR) ..... 10-2017-0172417

(51) Int. Cl.
*F24F 13/20* (2006.01)
*F24F 13/02* (2006.01)
*F24F 13/30* (2006.01)

(52) U.S. Cl.
CPC ..... *F24F 13/20* (2013.01); *F24F 13/0209* (2013.01); *F24F 13/0254* (2013.01); *F24F 13/30* (2013.01); *F24F 2013/205* (2013.01)

(58) Field of Classification Search
CPC .. F24F 2013/205; F24F 13/30; F24F 13/0254; F24F 13/0209; F24F 13/00
See application file for complete search history.

(56) References Cited

U.S. PATENT DOCUMENTS

2015/0211765 A1* 7/2015 Hancock ..... F24F 1/56 392/360
2016/0131390 A1* 5/2016 Kwon ..... F24F 13/30 29/890.035
2017/0276396 A1* 9/2017 Azumi ..... F24F 13/32

FOREIGN PATENT DOCUMENTS

JP 2004-340495 A 12/2004
JP 2005-69177 A 3/2005
(Continued)

OTHER PUBLICATIONS

International Search Report dated Mar. 13, 2019 in corresponding International Patent Application No. PCT/KR2018/015487.
(Continued)

*Primary Examiner* — Vivek K Shirsat
(74) *Attorney, Agent, or Firm* — Staas & Halsey LLP

(57) ABSTRACT

An air conditioner is disclosed. The disclosed air conditioner can comprise: a housing having an inflow port and a discharge port; a partition disposed inside the housing so as to divide the inside of the housing into a first space at the inflow port side and a second space at the discharge port side, and having at least one opening for allowing the first space and the second space to communicate; at least one blower unit disposed in the first space, and including a duct, which passes through the opening so as to protrude toward the second space and discharges the air of the first space to the second space; and a heat exchanger disposed in the second space.

10 Claims, 14 Drawing Sheets

(56) References Cited

FOREIGN PATENT DOCUMENTS

| | | | |
|---|---|---|---|
| JP | 2016-217680 | A | 12/2016 |
| JP | 2016-223679 | A | 12/2016 |
| KR | 10-2003-0000174 | A | 1/2003 |
| KR | 10-2004-0108253 | A | 12/2004 |
| KR | 10-2005-0018010 | A | 2/2005 |
| KR | 10-0471437 | B1 | 3/2005 |
| KR | 10-0552374 | B1 | 2/2006 |
| KR | 10-0698910 | B1 | 3/2007 |
| KR | 10-0745583 | B2 | 8/2007 |
| KR | 10-2009-0115278 | A | 11/2009 |
| KR | 10-1434191 | B1 | 8/2014 |

OTHER PUBLICATIONS

Office Action dated Jun. 13, 2022 in Japanese Application No. 10-2017-0172417.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/015487 filed on Dec. 7, 2018, which claims foreign priority benefit under 35 U.S.C. § 119 of Korean Patent Application No. 10-2017-0172417 filed on Dec. 14, 2017 in the Korean Intellectual Property Office, the contents of both of which are incorporated herein by reference.

TECHNICAL FIELD

The disclosure relates to an air conditioner.

BACKGROUND ART

An air conditioner is a device providing air suitable for a user's convenience by controlling outside air. Accordingly, the air conditioner may include a heat exchanger controlling a temperature of the air and a blower unit introducing the outside air into the air conditioner. The air introduced into the air conditioner by the blower unit may have a changed temperature as the air passes through the heat exchanger.

DISCLOSURE

Technical Problem

Here, a partition may be disposed between the blower unit and the heat exchanger to prevent air having the changed temperature from returning to the blower unit again. The partition may require a separate guide component to guide air moved from the blower unit to the heat exchanger. However, the guide component disposed in the partition may require a separate production process, and may be restricted to be disposed in a position where the guide component communicates with the blower unit. Accordingly, separate time and cost may be required to fixedly dispose the guide component in the position where the guide component communicates with the blower unit.

Technical Solution

The disclosure provides an air conditioner including a duct capable of guiding air moved from a blower unit to a heat exchanger in a simple configuration.

According to an embodiment of the disclosure, an air conditioner may include: a housing having an inflow port and a discharge port; a partition disposed inside the housing to divide the inside of the housing into a first space near the inflow port and a second space near the discharge port, and having at least one opening for allowing the first space and the second space to communicate with each other; at least one blower unit disposed in the first space, and including a duct passing through the opening to protrude toward the second space and discharging air of the first space to the second space; and a heat exchanger disposed in the second space.

The blower unit may include an upper case, a lower case coupled to the upper case and a blower fan, and the duct may be coupled to at least one of the upper case or the lower case.

The duct may include an upper surface coupled to the upper case and both side surfaces extending downward from both ends of the upper surface.

The duct may include a lower surface which is coupled to the lower case and in contact with lower ends of the both side surfaces.

The partition may include an extension portion formed to be bent at a lower end of the opening toward the second space.

The extension portion may be in contact with the lower ends of the both side surfaces of the duct.

The extension portion may be inclined downward toward the second space.

The both side surfaces of the duct may include protrude portions extending downward to be in contact with both ends of the extension portion, respectively.

The partition may include an insertion groove into which the protrude portion is inserted.

The lower case may include a connection portion connected to the extension portion.

The connection portion may be inclined downward toward the extension portion.

The connection portion may include: a support protrusion in contact with an upper end of the extension portion; and a coupling extension portion disposed downward from the support protrusion to be in contact with the partition.

The upper case or the lower case may include a coupling extension portion disposed on each of both sides of the duct to be in contact with the partition.

BEST MODE

To sufficiently understood configurations and effects of the disclosure, embodiments of the disclosure are described with reference to the accompanying drawings. However, the disclosure is not limited to embodiments described below, but may be implemented in several forms and may be variously modified. A description for these embodiments is provided only to make the disclosure complete and allow those skilled in the art to which the disclosure pertains to completely recognize the scope of the disclosure. In the accompanying drawings, sizes of components may be enlarged as compared with actual sizes for convenience of explanation, and ratios of the respective components may be exaggerated or reduced.

Terms such as 'first', 'second' and the like, may be used to describe various components, but the components are not to be interpreted to be limited to the terms. These terms may be used to differentiate one component from other components. For example, a 'first' component may be named a 'second' component and the 'second' component may also be similarly named the 'first' component, without departing from the scope of the disclosure.

Terms used in embodiments of the disclosure may be interpreted as the same meanings as meanings that are generally known to those skilled in the art unless defined otherwise.

Hereinafter, structure and operation of the air conditioner according to an embodiment of the disclosure are described in sequence with reference to the drawings.

Figure 1:
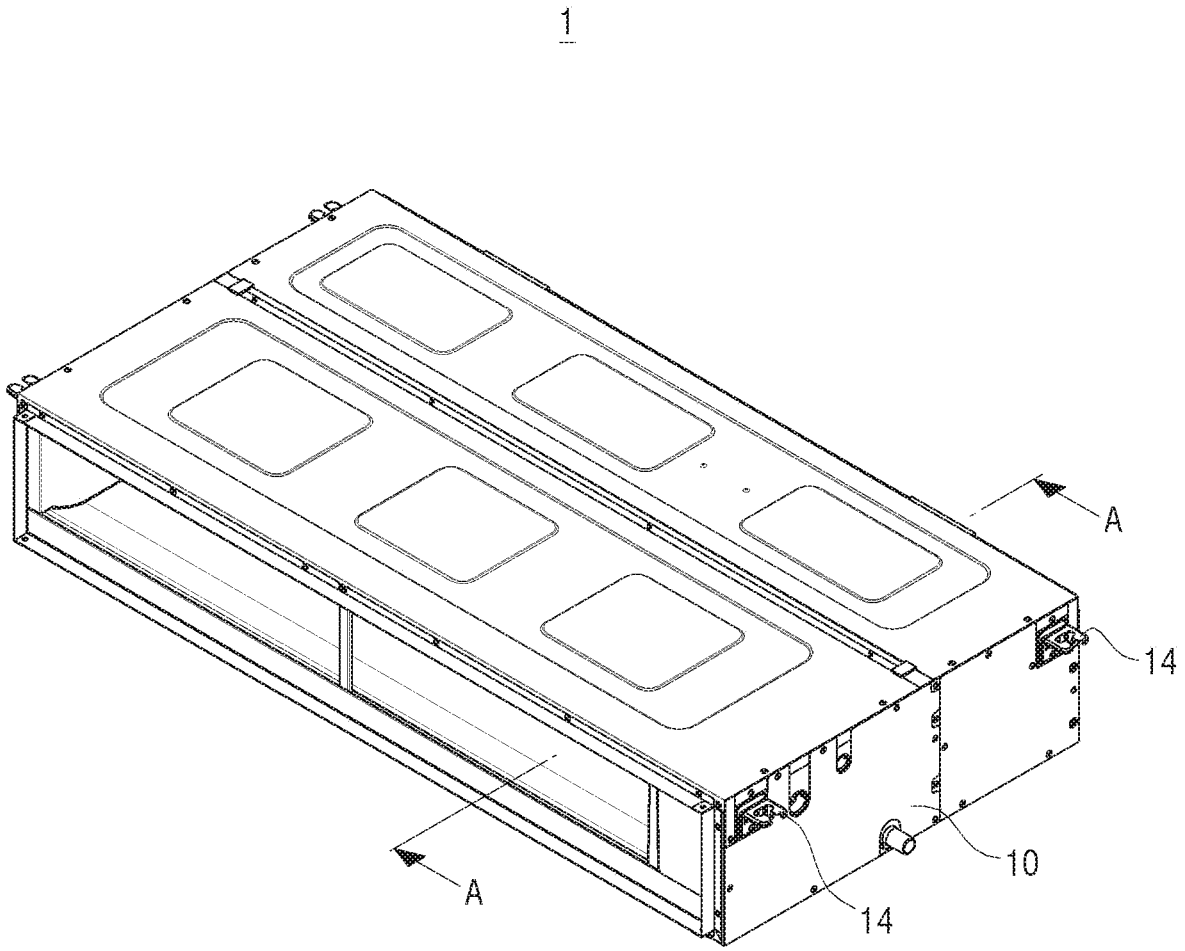
FIG. 1 is a perspective view showing an air conditioner according to an embodiment of the disclosure.
Figure 2:
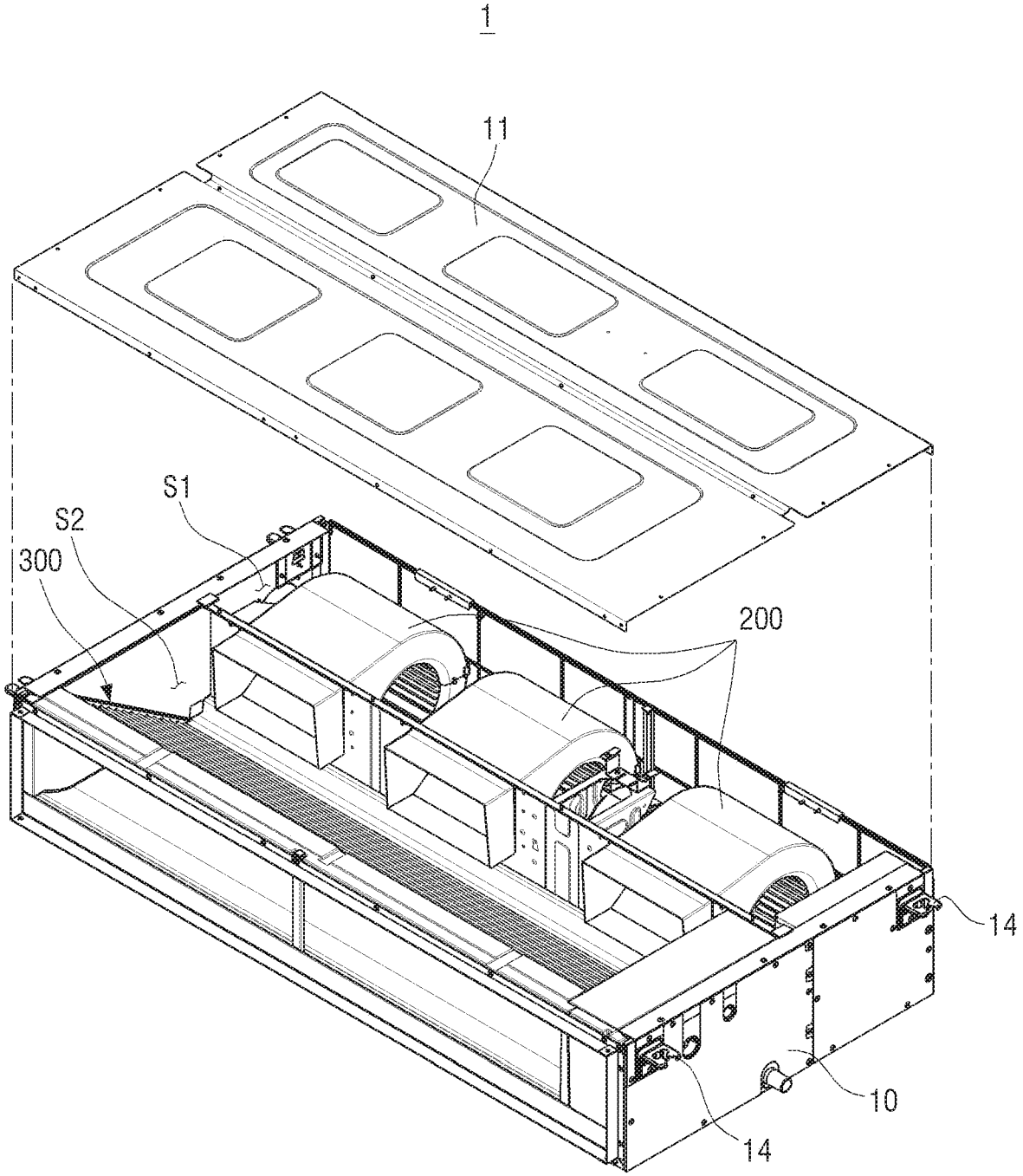
FIG. 2 is an exploded perspective view showing the air conditioner having a cover separated therefrom.
Figure 3:
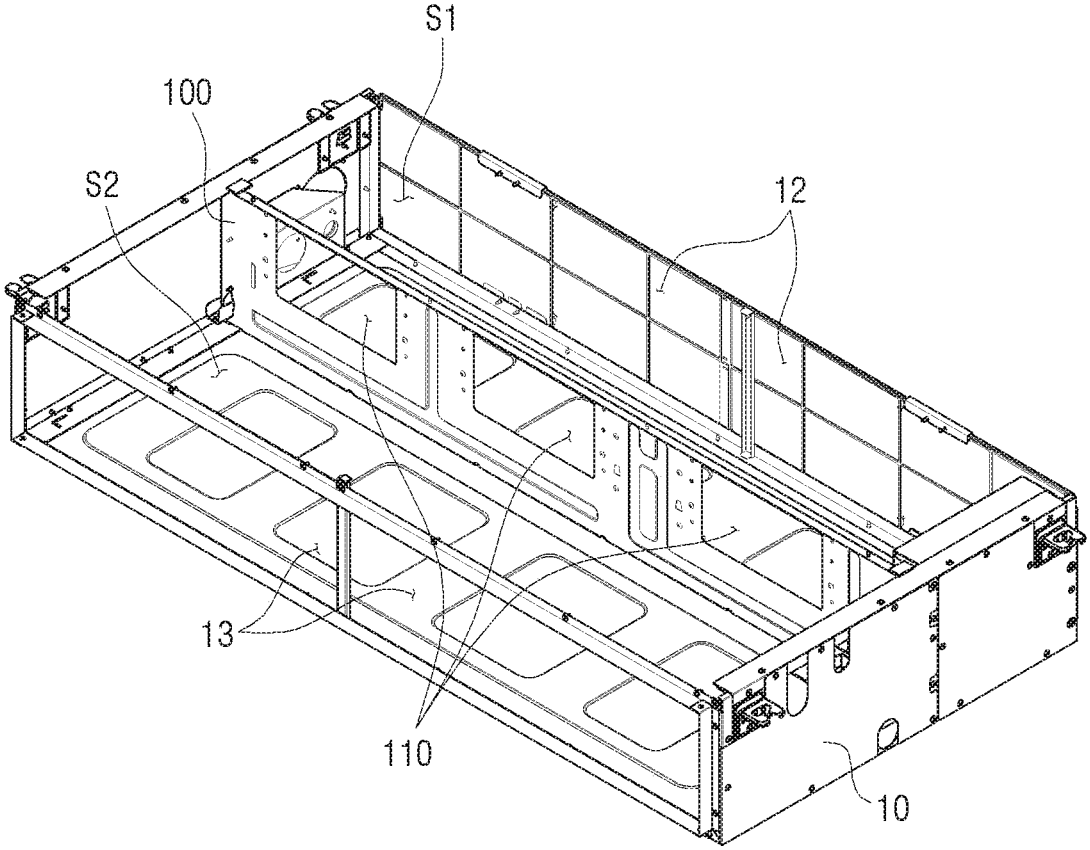
FIG. 3 is a perspective view showing a coupling between a housing and a partition without a blower unit and a heat exchanger.
Figure 4:
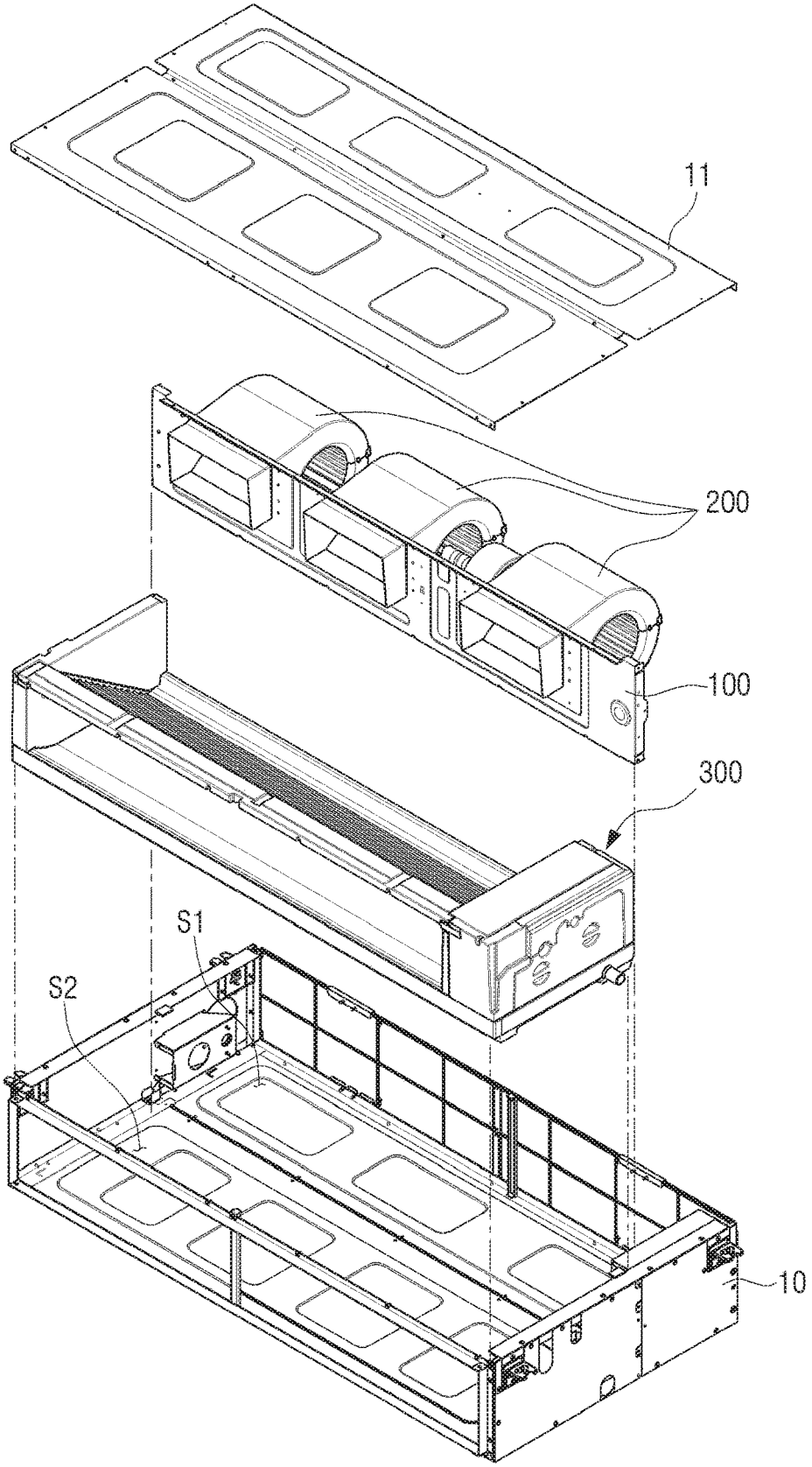
FIG. 4 is an exploded perspective view showing the air conditioner.
Figure 5:
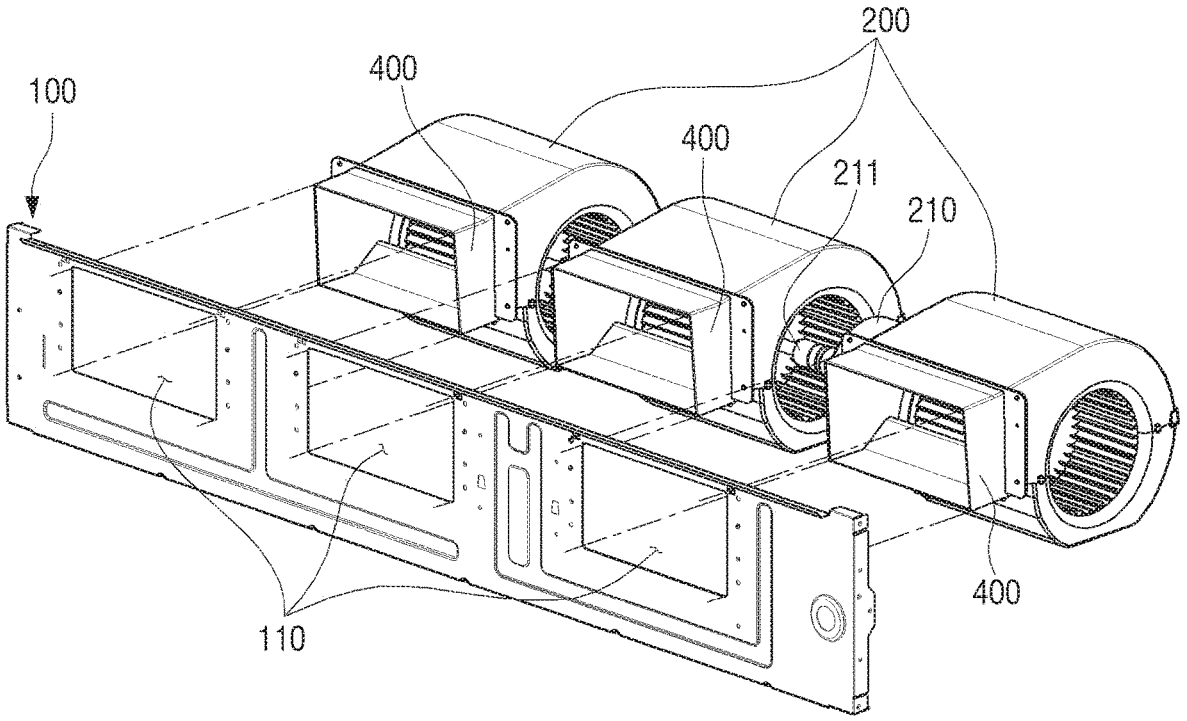
FIG. 5 is an exploded perspective view showing the blower unit and the partition.

FIG. 1 is a perspective view showing an air conditioner 1 according to an embodiment of the disclosure; FIG. 2 is an exploded perspective view showing the air conditioner 1 having a cover 11 separated therefrom; FIG. 3 is a perspective view showing a coupling between a housing 10 and a partition 100 without a blower unit 200 and a heat exchanger 300; FIG. 4 is an exploded perspective view showing the air conditioner; and FIG. 5 is an exploded perspective view showing the blower unit and the partition.

Referring to FIGS. 1 and 2, the air conditioner 1 may include the housing 10 accommodating the partition 100, the blower unit 200 and the heat exchanger 300.

The housing 10 may have a rectangular parallelepiped shape. However, the housing 10 is not limited to this shape, and may have any shape as long as accommodating the partition 100, the blower unit 200 and the heat exchanger 300.

Referring to FIG. 1, a coupling member 14 may be provided outside the housing 10. The coupling member 14 may serve to fix the housing 10 of the air conditioner 1 to an external support (not shown), and may fix the housing 10 at a fixed position by various types of coupling such as screw coupling and snap coupling.

Referring to FIG. 2, the housing 10 may include one or more covers 11. The covers 11 may be disposed on each side except an inflow port 12 (see FIG. 3) and a discharge port 13 (see FIG. 3), and may divide an inside of the housing 10 from the outside.

The inflow port 12, through which air is introduced from the outside, may be formed on one surface of the housing 10. The discharge port 13, through which air having a changed temperature by the heat exchanger 300 is discharged, may be formed on the other surface of the housing 10 opposite to the inflow port 12. However, the discharge port 13 may be formed not only on the other surface of the housing 10 opposite to the inflow port 12 but also on various positions of the housing 10 as long as the air introduced through the inflow port 12 can be discharged from the air conditioner 1 through the discharge port 13.

Referring to FIG. 3, the partition 100 may be disposed inside the housing 10 to divide the inside of the housing 10 into a first space S1 near the inflow port 12 and a second space S2 near the discharge port 13.

The first space S1 and the second space S2 in the housing 10, which are divided by the partition 100, may communicate with each other by an opening 110 of the partition 100. That is, the air may be moved from the first space S1 to the second space S2 only through the opening 110 of the partition 100, and cannot be moved to the remaining portions of the partition 100 except the opening 110 of the partition 100.

The partition 100 may be screw coupled to the inside of the housing 10. However, as long as the partition 100 can be stably fixed to housing 10, the fixing method may be used in various ways such as snap coupling.

The opening 110 may be formed in a shape corresponding to a duct 400 (see FIG. 6) of the blower unit 200 described below. Accordingly, the duct 400 may be inserted into the opening 110 to pass through the opening 110.

The number of the opening 110 may be equal to that of the blower unit 200. Therefore, in case that each duct 400 of the blower unit 200 is coupled to each opening 110, air of the second space S2 may be the air that moved from the first space S1 through the duct 400.

Referring to FIG. 4, the blower unit 200 may be disposed in the first space S1 of the housing 10, and the heat exchanger 300 may be disposed in the second space S2 of the housing 10. Accordingly, the air introduced by the blower unit 200 may be moved to the heat exchanger 300.

The blower unit 200 may introduce air outside the housing 10 into the housing 10, and discharge the introduced air to the second space S2 through the duct 400, thereby allowing the air introduced to the second space S2 to be discharged through the heat exchanger 300 to the discharge port 13 of the housing 10.

Figure 7:
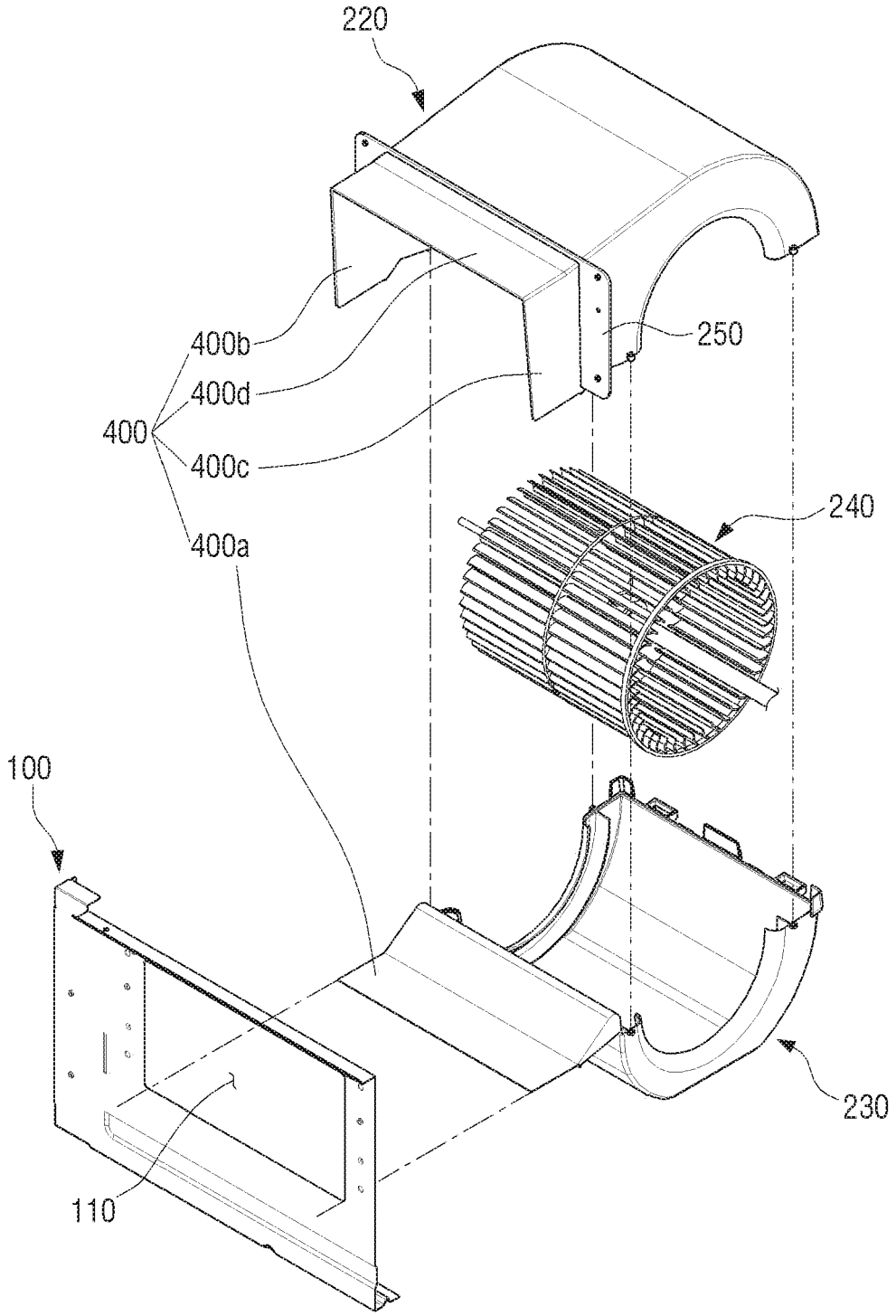
FIG. 7 is an exploded perspective view showing one blower unit and a portion of the partition according to an embodiment of the disclosure.

The blower unit 200 may include an upper case 220 (see FIG. 7), a lower case 230 (see FIG. 7) coupled to the upper case 220 and a blower fan 240 (see FIG. 7). FIG. 7 shows the blower fan 240 as a centrifugal fan, however, the blower fan 240 may be configured as various known fans such as a side flow fan and a cross flow fan, as necessary.

A plurality of blower units 200 may be used as necessary, and three blower units 200 may be disposed according to an embodiment of the disclosure. Here, all the blower units 200 may be connected to each other by a single shaft 211 (see FIG. 5). The single shaft 211 may be connected to a motor 210 (see FIG. 5) for driving the plurality of blower units 200.

The heat exchanger 300 may be disposed in the second space S2 inside the housing 10. The heat exchanger 300 may be configured to have a plurality of tubes, and a high temperature material or a low temperature material may flow through the plurality of tubes of the heat exchanger 300. In case that the high temperature material flows through the tubes of the heat exchanger 300, air passing through the heat exchanger 300 may be increased in temperature through heat exchange; and in case that the low temperature material flows through the tube of the heat exchanger 300, the air passing through the heat exchanger 300 may be dropped in temperature through the heat exchange. Accordingly, the air conditioner 1 may adjust a temperature of the outside air based on a user's need in various ways.

Referring to FIG. 5, the blower unit 200 may include the duct 400 passing through the opening 110 to protrude toward the second space S2 and discharge air of the first space S1 into the second space S2. Accordingly, the duct 400 may guide the air moved to the second space S2 by the blower unit 200 to the heat exchanger 300 disposed in front of the blower unit 200.

The duct 400 may be produced as a separate member and coupled to the blower unit 200. In detail, the duct 400 may be coupled to at least one of the upper case 220 or the lower case 230. Alternatively, the duct 400 may be integrally formed with the upper case 220 or the lower case 230. In this case, there is no need for processes of producing the duct 400 and combining the duct 400 to the blower unit 200, and production cost and time may thus be reduced by reducing the number of components and the number of fastenings.

A cross section of the duct 400 parallel to the partition 100 may have a shape corresponding to that of the opening 110. Accordingly, the duct 400 may pass through and be inserted into the opening 110 to be fixed to and supported by the opening 110. By inserting and fixing the duct 400 to the opening 110, the blower unit 200 connected to the duct 400 may be fixed and the air moved by the blower unit 200 may also be guided to the heat exchanger 300.

The upper case 220 or lower case 230 of the blower unit 200 may include a coupling extension portion 250 disposed on each of both sides of the duct 400 to be in contact with the partition 100.

The coupling extension portion 250 may serve to stably fix the upper case 220 or the lower case 230 to the partition 100, and the coupling extension portion 250 may be in contact with and screw coupled to the partition 100. Therefore, for convenient coupling between the partition 100 and the coupling extension portion 250, the coupling extension portion 250 may be formed in parallel to the partition 100. However, the coupling between the partition 100 and the coupling extension portion 250 is not limited thereto, and may be implemented in various ways such as snap coupling, as necessary.

Figure 6:
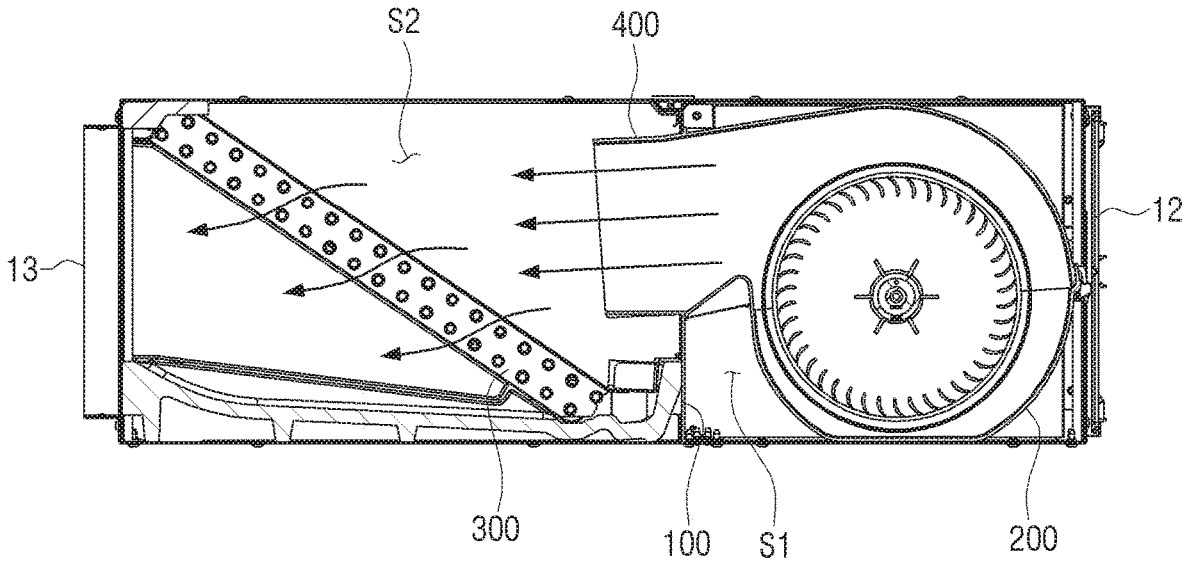
FIG. 6 is a cross-sectional view taken along line A-A of FIG. 1.

Hereinafter, an operation of the air conditioner 1 is described with reference to FIG. 6. FIG. 6 is a cross-sectional view taken along line A-A of FIG. 1.

The outside air may be introduced by the blower unit 200 through the inflow port 12 of the housing 10. The introduced air may be introduced to a side of the blower unit 200 and moved to the heat exchanger 300 of the second space S2 through the duct 400.

The air moved to the second space S2 may have the changed temperature through heat exchange with the heat exchanger 300 while passing through the heat exchanger 300. The air having the changed temperature may be discharged to the outside through the discharge port 13 of the housing 10.

FIG. 7 is an exploded perspective view showing one blower unit 200 and a portion of the partition 100 according to an embodiment of the disclosure. For convenience of description, shown are one blower unit 200 and only a portion of the partition 100 coupled with the one blower unit 200.

The upper case 220 and the lower case 230 of the blower unit 200 may be coupled to each other to form an appearance of the blower unit 200. The upper case 220 may have an upper surface 400*d* and both side surfaces 400*b* and 400*c* of the duct 400, and the lower case 230 may have a lower surface 400*a* of the duct 400. That is, the duct 400 may include the upper surface 400*d* coupled to the upper case 220 and the both side surfaces 400*b* and 400*c* extending downward from both ends of the upper surface 400*d*; and the duct 400 may include a lower surface 400*a* which is coupled to the lower case 230 and in contact with lower ends of the both side surfaces 400*b* and 400*c*.

By coupling the upper case 220 with the lower case 230, the duct 400 may have a shape of a substantially rectangular parallelepiped corresponding to the opening 110 of the partition 100.

However, the duct 400 is not limited to the shape according to the above embodiment. The duct 400 may be formed by coupling a portion of the duct 400 to each of the upper case 220 and the lower case 230 as necessary and then coupling the upper case 220 and the lower case 230.

In detail, the upper case 220 may form one surface of the duct 400 and the lower case 230 may form the other surfaces of the duct 400. If necessary, the upper case 220 and the lower case 230 may include various surfaces forming the duct 400, respectively. For example, the upper case 220 may form two surfaces of the duct 400 having a shape of a two-surface rectangular parallelepiped without two opposite surfaces, and the lower case 230 may form the remaining two surfaces of the duct 400.

Figure 8:
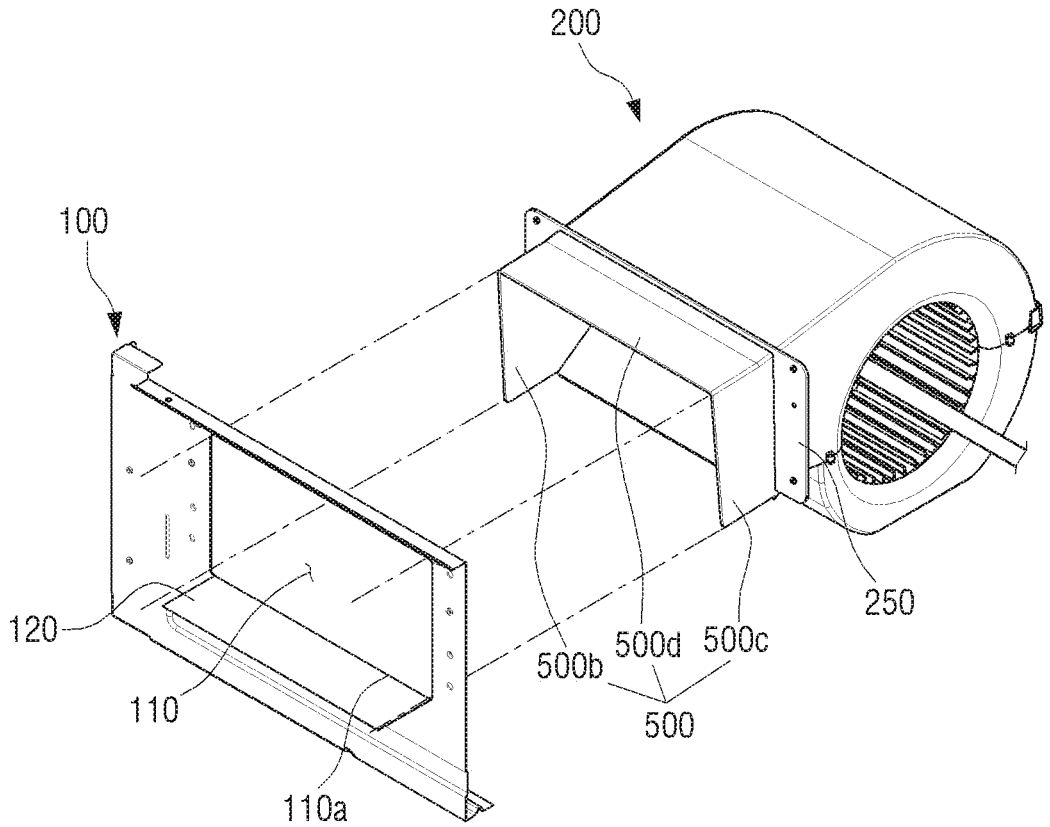
FIG. 8 is an exploded perspective view showing a blower unit and a partition according to another embodiment of the disclosure.
Figure 9:
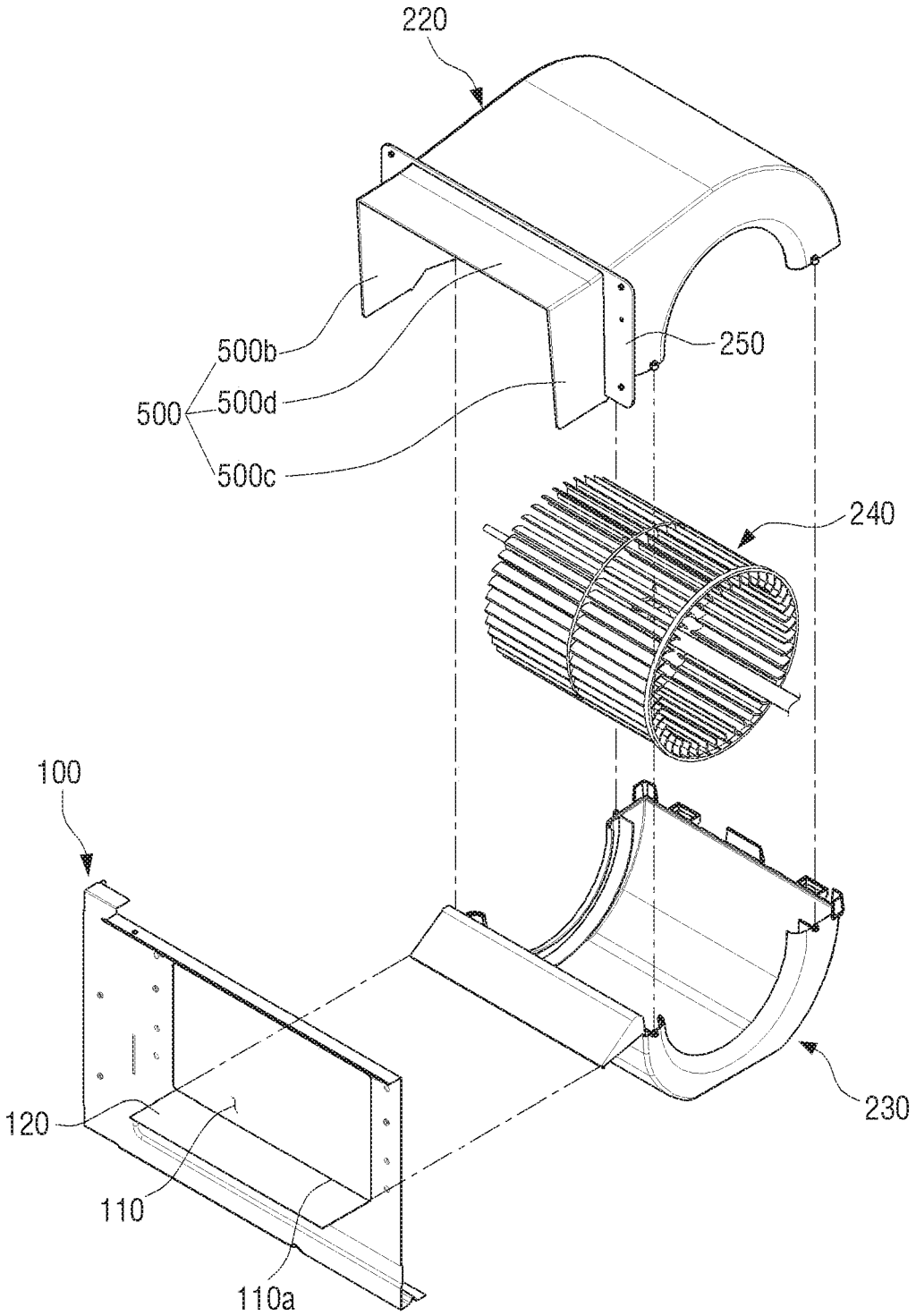
FIG. 9 is an exploded perspective view showing the blower unit and the partition according to another embodiment of the disclosure in a state in which upper and lower cases of the blower unit are separated from each other.
Figure 10:
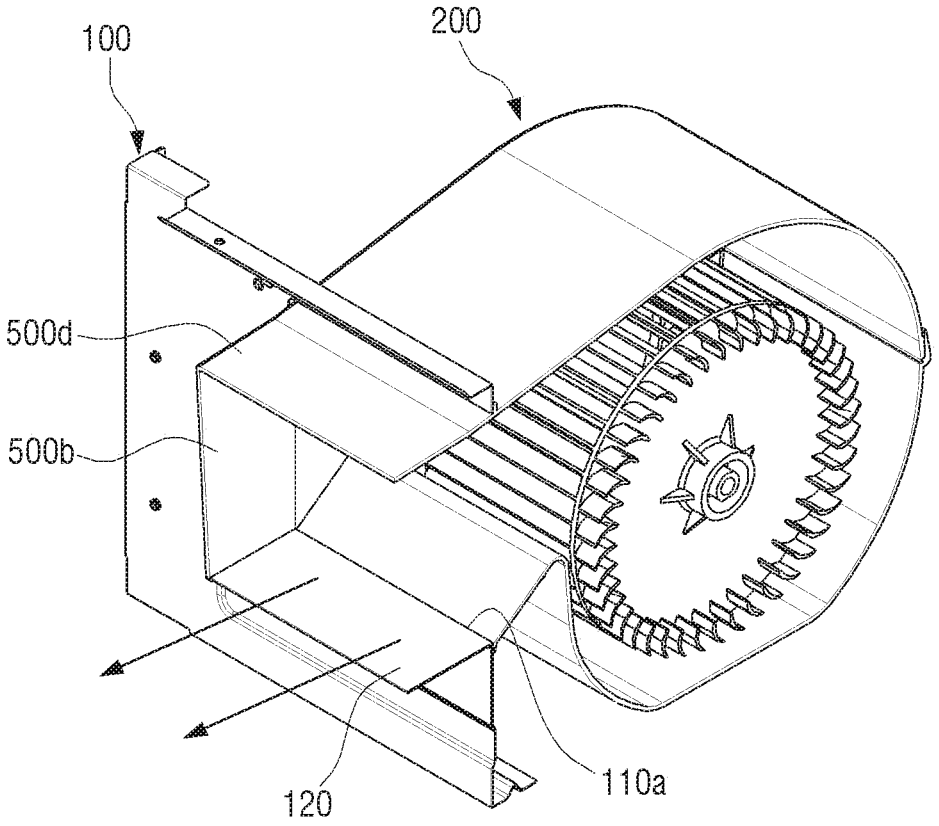
FIG. 10 is a cross-sectional view of the blower unit and the partition according to another embodiment of the disclosure.

FIG. 8 is an exploded perspective view showing a blower unit and a partition according to another embodiment of the disclosure; FIG. 9 is an exploded perspective view showing the blower unit and the partition according to another embodiment of the disclosure in a state in which upper and lower cases of the blower unit are separated from each other; and FIG. 10 is a cross-sectional view of the blower unit and the partition according to another embodiment of the disclosure.

The same reference numeral is used for the same component, which is not described in detail. The same component denoted by the same reference numeral, which is not described, has the same configuration as described above.

In addition, for convenience of description, shown are one blower unit 200 and only a portion of the partition 100 coupled with the one blower unit 200.

The partition 100 may include an extension portion 120 formed to be bent at a lower end 110*a* of the opening 110 toward the second space S2. The extension portion 120 may be in contact with both side surfaces 500*b* and 500*c* of a duct 500. Accordingly, the duct 500 and the extension portion 120 in contact with the duct 500 may guide air moved by the blower unit 200 to the heat exchanger 300.

The extension portion 120 may be formed to be bent at a portion of the partition 100. Accordingly, there is no need for a separate production of the extension portion 120, and the production cost may thus be reduced by reducing the number of components and the number of fastening of each component.

In addition, the extension portion 120 may be in contact with the both side surfaces 500*b* and 500*c* of the duct 500 to guide the air moved by the blower unit 200 to the heat exchanger 300. Accordingly, the air moved by the blower unit 200 may be moved toward the heat exchanger 300 without leaking below the duct 500.

The extension portion 120 may be formed to extend from one end of the opening 110. In detail, in case that the opening 110 has a rectangular shape, the extension portion 120 may be formed to be bent at at least one surface of the partition 100. Therefore, in case that the extension portion 120 forms at least one surface of a flow path, the duct 500 of the blower unit 200 may form the remaining surfaces 500*b*, 500*c* and 500*d* of the flow path.

The duct 500 configured of the upper surface 500*d* and the both side surfaces 500*b* and 500*c* described above may be coupled to the upper case 220, and the duct 500 and the upper case 220 may be integrally formed with each other as shown in FIG. 9.

Air discharged from the blower unit 200 toward the second space S2 may be easily moved to the second space S2 along the flow path formed by the upper surface 500*d* and the both side surfaces 500*b* and 500*c* of the duct 500 and the extension portion 120 of the partition 100.

The upper case 220 and the duct 500 may be coupled to each other or integrally formed with each other, and the blower unit 200 connected to the partition 100 may thus be stably fixed to and supported by the partition 100. Therefore, even in case that there is no separate fixing member, the blower unit 200 may maintain a state of being connected to the partition 100.

Figure 11:
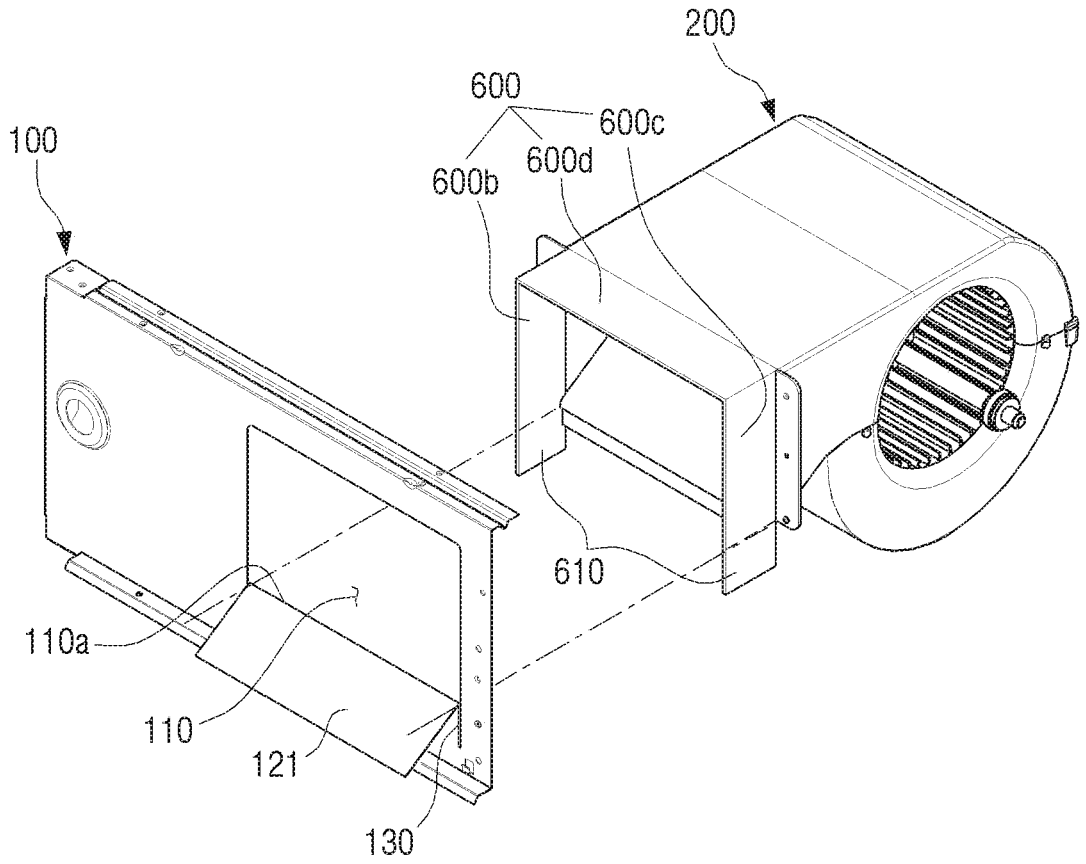
FIG. 11 is an exploded perspective view showing a blower unit and a partition according to still another embodiment of the disclosure.
Figure 12:
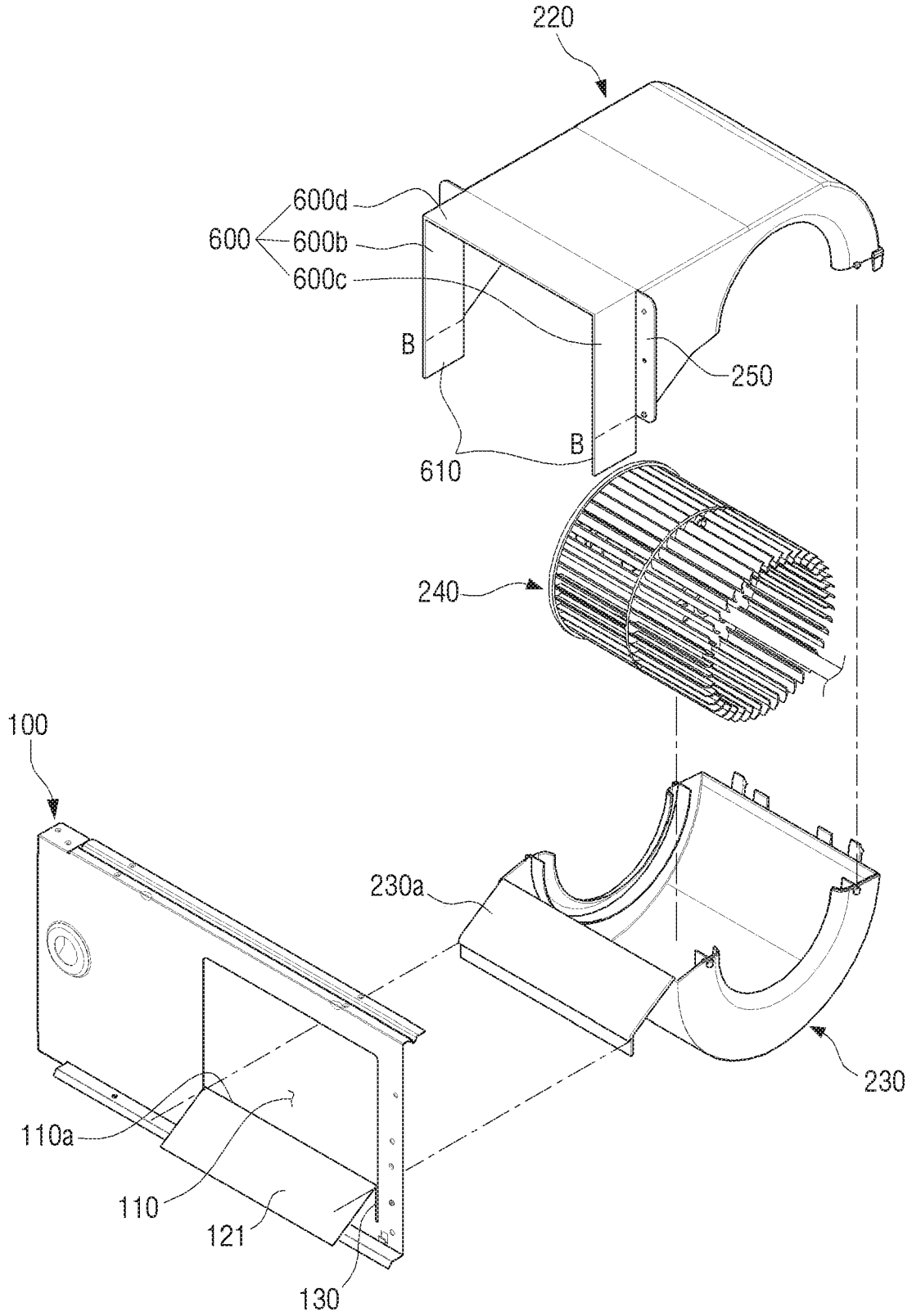
FIG. 12 is an exploded perspective view showing the blower unit and the partition according to still another embodiment of the disclosure in a state in which upper and lower cases of the blower unit are separated from each other.
Figure 13:
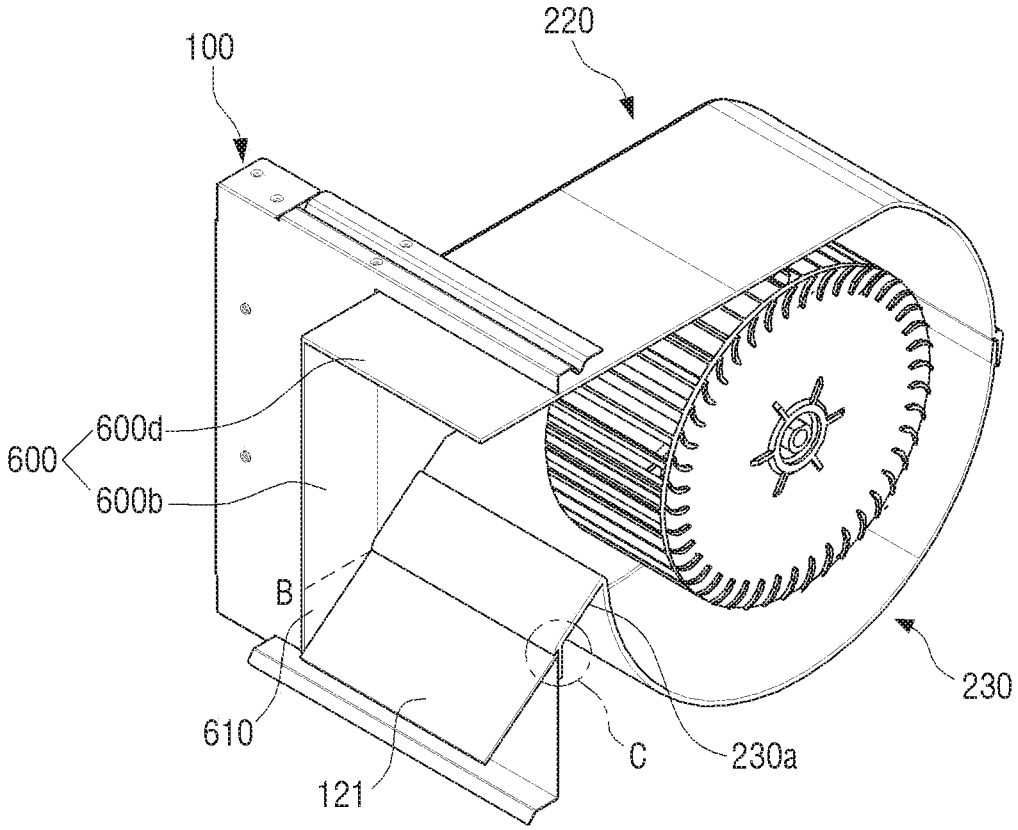
FIG. 13 is a cross-sectional view showing the blower unit and the partition according to still another embodiment of the disclosure.

FIG. 11 is an exploded perspective view showing a blower unit and a partition according to still another embodiment of the disclosure; FIG. 12 is an exploded perspective view showing the blower unit and the partition according to still another embodiment of the disclosure in a state in which upper and lower cases of the blower unit are separated from each other; and FIG. 13 is a cross-sectional view showing the blower unit and the partition according to still another embodiment of the disclosure.

The same reference numeral is used for the same component, which is not described in detail. The same component denoted by the same reference numeral, which is not described, has the same configuration as described above.

In addition, for convenience of description, shown are one blower unit 200 and only a portion of the partition 100 coupled with the one blower unit 200.

A duct 600 may include an upper surface 600*d* coupled to the upper case 220 and both side surfaces 600*b* and 600*c* extending downward from both ends of the upper surface 600*d*. However, if necessary, the duct 600 may be integrally formed with the upper case 220.

The duct 600 may include protrude portions 610 extending downward from lower ends (dotted lines B in FIG. 12) of the both side surfaces 600*b* and 600*c* of the duct 600. The protrude portions 610 may be in contact with both ends 121*a* and 121*b* of an extension portion 121 described below, respectively.

The partition 100 may include an insertion groove 130 into which the protrude portion 610 is inserted. The insertion groove 130 may be formed to extend from one corner of the opening 110 by a predetermined length. Accordingly, the protrude portion 610 may be inserted into the insertion groove 130 and fixed to the partition 100.

The partition 100 may include the extension portion 121 formed to be bent from the lower end 110*a* of the opening 110 toward the second space S2. The extension portion 121 may be inclined downward toward the second space S2. Accordingly, as the extension portion 121 in contact with the protrude portion 610 of the duct 600 and the duct 600 are closer to the heat exchanger 300, a shape formed by the contact between the extension portion 121 and the duct 600 may have a wider cross-sectional area. Therefore, air moved by the blower unit 200 may become slower as the air is moved closer to the heat exchanger 300, and the slower-speed air may undergo sufficient heat exchange time in the heat exchanger 300. Therefore, it is possible to increase heat exchange efficiency of the air in the heat exchanger 300.

The lower case 230 may include a connection portion 230*a* connected to the extension portion 121. The connection portion 230*a* may be inclined downward toward the extension portion 121. Accordingly, as being closer to the heat exchanger 300, a shape formed by coupling the upper case 220 with the lower case 230 may have a wider cross-sectional area. Therefore, the air moved by the blower unit 200 may become slower as the air is moved closer to the heat exchanger 300, and the slower speed air may undergo sufficient heat exchange time in the heat exchanger 300. Therefore, it is possible to increase the heat exchange efficiency of the air in the heat exchanger 300.

The lower case 230 may not be coupled to the duct 600. Therefore, the lower case 230 may not pass through and be fixed to the partition 100. Accordingly, in case that the blower unit 200 needs to be repaired while the blower unit 200 is coupled to the partition 100, it is possible to repair an inside of the blower unit 200 by detaching only the lower case 230 of the blower unit 200. Therefore, in case that the duct 600 is coupled to only the upper case 220, the repair may be easily performed by detaching the lower case 230.

Figure 14:
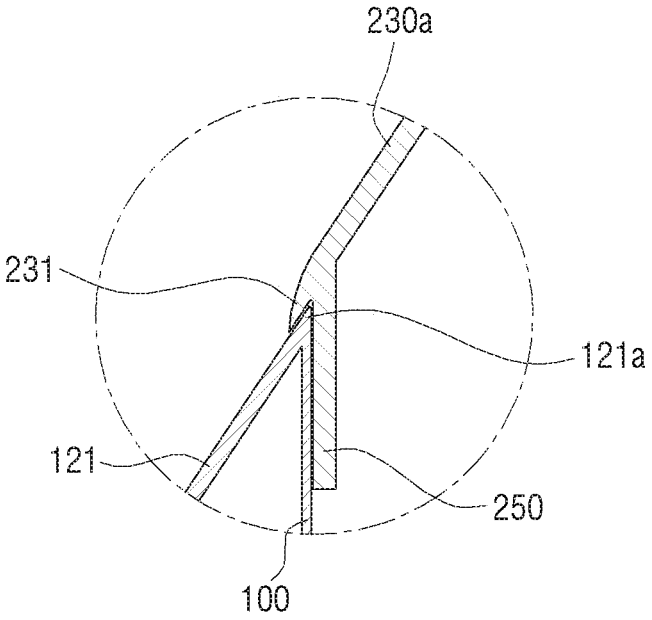
FIG. 14 is an enlarged cross-sectional view of portion C in FIG. 13.

FIG. 14 is an enlarged cross-sectional view of portion C in FIG. 13.

Referring to FIG. 14, the connection portion 230*a* may include a support protrusion 231 in contact with the upper end 121*a* of the extension portion 121, and a coupling extension portion 250 disposed downward from the support protrusion 231 to be in contact with the partition 100.

The coupling extension portion 250 may be formed to extend downward from the connection portion 230*a*. The coupling extension portion 250 may be in contact with and screw coupled to the partition 100. Therefore, the coupling extension portion 250 may be formed in parallel to the partition 100. However, if necessary, the coupling extension portion 250 may be coupled to the partition 100 in various ways such as snap coupling.

The support protrusion 231 may be formed to extend from the lower case 230 toward the opening 110 by a predetermined length. Accordingly, in case that the blower unit 200 is coupled to the partition 100, the support protrusion 231 may naturally connect the connection portion 230*a* of the lower case 230 with the extension portion 121 of the partition 100. Accordingly, the air moved by the blower unit 200 may be moved to the heat exchanger 300 without eddy motion occurring by a step difference in the shapes. The support protrusion 231 may have any shape as long as supporting the lower case 230 to be held in the opening 110, and may have various shapes as necessary.

Although the embodiments of the disclosure are illustrated and described hereinabove, the disclosure is not limited to the above-mentioned specific embodiments, but may be variously modified by those skilled in the art to which the disclosure pertains without departing from the scope and spirit of the disclosure as disclosed in the accompanying claims. These modifications also need to be understood to fall within the scope of the disclosure.

The invention claimed is:

1. An air conditioner comprising:

a housing having an inflow port and a discharge port;

a partition disposed inside the housing to divide the inside of the housing into a first space near the inflow port and a second space near the discharge port, and having at least one opening for allowing the first space and the second space to communicate with each other;

at least one blower unit disposed in the first space, and including a duct passing through the at least one opening to protrude toward the second space and discharging air in the first space to the second space; and a heat exchanger disposed in the second space, wherein the at least one blower unit includes:

an upper case;

a lower case coupled to the upper case; and a blower fan, and the duct is coupled to at least one of the upper case and the lower case, the duct includes:

an upper surface coupled to the upper case; and a plurality of side surfaces respectively extending downward from both ends of the upper surface, and the partition includes:

an extension portion formed to be bent at a lower end of the opening toward the second space.

2. The air conditioner as claimed in claim 1, wherein the duct further includes a lower surface which is coupled to the lower case and in contact with lower ends of the each of the plurality of side surfaces.

3. The air conditioner as claimed in claim 1, wherein the extension portion is in contact with the lower ends of the each of the plurality of side surfaces of the duct.

4. The air conditioner as claimed in claim 3, wherein the extension portion is inclined downward toward the second space.

5. The air conditioner as claimed in claim 4, wherein the each of the plurality of side surfaces of the duct includes a protrude portion extending downward to be in contact with both ends of the extension portion, respectively.

6. The air conditioner as claimed in claim 5, wherein the partition includes an insertion groove into which the protrude portion is inserted.

7. The air conditioner as claimed in claim 5, wherein the lower case includes a connection portion connected to the extension portion.

8. The air conditioner as claimed in claim 7, wherein the connection portion is inclined downward toward the extension portion.

9. The air conditioner as claimed in claim 8, wherein the connection portion includes:

a support protrusion in contact with an upper end of the extension portion; and a coupling extension portion disposed downward from the support protrusion to be in contact with the partition.

10. The air conditioner as claimed in claim 1, wherein one of the upper case and the lower case includes a coupling extension portion disposed on each of both sides of the duct to be in contact with the partition.

* * * * *